US006558806B2

(12) United States Patent
Watanabe

(10) Patent No.: US 6,558,806 B2
(45) Date of Patent: May 6, 2003

(54) HEAT-RESISTANT STRUCTURAL BODY, HALOGEN-BASED CORROSIVE GAS-RESISTANT MATERIAL AND HALOGEN-BASED CORROSIVE GAS-RESISTANT STRUCTURAL BODY

(75) Inventor: Morimichi Watanabe, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/911,704

(22) Filed: Jul. 24, 2001

(65) Prior Publication Data

US 2002/0034633 A1 Mar. 21, 2002

(30) Foreign Application Priority Data

Jul. 27, 2000 (JP) ..... 2000-226865

(51) Int. Cl.[7] ..... B32B 15/04; C04B 35/04

(52) U.S. Cl. ..... 428/469; 428/689; 428/696; 428/698; 428/704; 501/118; 501/119; 501/151; 501/153

(58) Field of Search ..... 428/336, 696, 428/702, 446; 501/118, 119, 121, 151, 152, 153

(56) References Cited

U.S. PATENT DOCUMENTS 5,514,225 A * 5/1996 Yamada et al. ..... 148/238
5,811,195 A * 9/1998 Bercaw et al. ..... 428/472
6,139,983 A * 10/2000 Ohashi et al. ..... 118/726
6,364,965 B1 * 4/2002 Masuda et al. ..... 148/223
6,406,799 B1 * 6/2002 Aihara et al. ..... 428/624

FOREIGN PATENT DOCUMENTS

| | | |
|---|---|---|
| EP | 0 666 334 A1 | 8/1995 |
| EP | 0 795 621 A1 | 9/1997 |
| FR | 2 241 135 | 3/1975 |
| FR | 2 727 108 | 5/1996 |

* cited by examiner

*Primary Examiner*—Deborah Jones
*Assistant Examiner*—G. A. Blackwell-Rudasill
(74) *Attorney, Agent, or Firm*—Burr & Brown

(57) ABSTRACT

In order to improve a heat-cycling-durability of a structural body in which a nitrided material is provided on a substrate containing at least metallic aluminum, a heat-resistant structural body having a substrate containing at least metallic aluminum and a nitrided material formed on the substrate provided. The nitrided material is composed mainly of an aluminum nitride phase and a metallic aluminum phase. Preferably, the nitrided material contains at least one metallic element selected from Group 2A, Group 3A, Group 4A, and Group 4B in Periodic Table.

12 Claims, No Drawings

HEAT-RESISTANT STRUCTURAL BODY, HALOGEN-BASED CORROSIVE GAS-RESISTANT MATERIAL AND HALOGEN-BASED CORROSIVE GAS-RESISTANT STRUCTURAL BODY

BACKGROUND OF THE INVENTION

1. Field of the Invention

The present invention relates to a heat-resistant structural body, a halogen-based corrosive gas-resistant material and a halogen-based corrosive gas-resistant structural body.

2. Description of the Related Art

As wirings in the semiconductors and liquid crystal panels become finer, fine workings with dry processings are progressing. With the demand for such fine workings, a halogen-based corrosive gas is used as a film-forming gas or an etching gas for the semiconductors and the like. It is known that aluminum nitride exhibits high corrosion resistance against such a halogen-based corrosion gas. Therefore, members having aluminum nitride on their surfaces have been used in semiconductor-producing apparatuses, liquid crystal panel-producing apparatuses and the like.

When aluminum contacts the air, its surface is oxidized to form a thin oxidized film. Since this oxidized film is an extremely stable passive phase, the surface of aluminum could not be nitrided by a simple nitriding method. Under the circumferences, the following methods have been developed to modify the surface of aluminum and form aluminum nitride thereon.

JP-A-60-211061 discloses a method in which after the inner pressure of the chamber is reduced to a given level, and hydrogen or the like is introduced thereinto, discharging is conducted to heat the surface of a member such as aluminum to a given temperature, further argon gas is introduced and discharging is conducted to activate the surface of the member, and the surface of the aluminum member is ionically nitrided through introducing nitrogen gas. In addition, JP-A-7-166321 discloses a method in which a nitriding aid made of aluminum powder is contacted with the surface of the aluminum, and aluminum nitride is formed on the surface of aluminum through heating in a nitrogen atmosphere.

An aluminum nitride film itself has high heat resistance, high heat-cycling durability and high Vickers hardness. However, in such a technique that forms an aluminum nitride film on an aluminum substrate, the aluminum nitride film tends to peel off from the substrate when heat-cyclings are applied, depending on a difference in thermal expansions between the obtained aluminum nitride film and metallic aluminum or a state of an interface between the substrate and the aluminum nitride film.

SUMMARY OF THE INVENTION

It is an object of the present invention to improve heat-cycling durability of a structural body in which a nitrided material is provided on a substrate containing at least metallic aluminum.

It is another object of the present invention to further improve halogen-based corrosive gas-resistance of a structural body comprising a substrate containing at least metallic aluminum and a nitrided material formed on the substrate.

It is yet another object of the present invention to provide a nitrided material having high resistance against hydrofluoric acid and a halogen-based corrosive gas and high heat-resistance.

The present invention relates to a heat-resistant structural body comprising a substrate containing at least metallic aluminum and a nitrided material formed on the substrate, wherein the nitrided material is composed mainly of an aluminum nitride phase and a metallic aluminum phase.

The present inventors found that such a lamination structural body had higher heat resistance, especially heat-cycling durability than a structural body where an aluminum nitride film was formed on metallic aluminum. The reason of this is not clear, but it is considered that since the film is the mixed phase of aluminum nitride phase and the metallic aluminum phase, the film has a closer expansion coefficient to aluminum of the substrate than the aluminum nitride film does, so that stress on the interface between the substrate and the nitrided material is relaxed.

In the present invention, the nitrided material may be composed mainly of the aluminum nitride phase and the metallic aluminum phase, and other crystal phase or amorphous phase may exist. However, the total amount of the aluminum nitride phase and the metallic aluminum phase is preferably not less than 80 mol %, and more preferably not less than 90 mol %.

DESCRIPTION OF THE PREFERRED EMBODIMENT

In a preferred embodiment, the nitrided material contains at least one metallic element selected form Group 2A, Group 3A, Group 4A and Group 4B in Periodic Table.

In a particularly preferred embodiment, the nitrided material contains at least one metallic element selected from Group 2A, Group 3A and Group 4A in Periodic Table. By incorporating such a metallic element, resistances of this structural body against the halogen-based corrosion gas, especially fluorine-based corrosive gas was found to be significantly improved.

That is, it is known that the halogen-based corrosive gas and its plasma used in semiconductor producing processes etc. exhibit strong chemical and physical interactions with the substrate to be treated. Silicon, silicon oxide and the like are etched by using these interactions. The present inventors exposed a various kind of the structural bodies to the halogen-based corrosive gas, and, as a result, found that the durability of the structural body against chemical corrosion of the plasma of the halogen-based corrosive gas was improved by incorporating at least one metallic element selected from Group 2A, Group 3A, Group 4A and Group 4B in Periodic Table into the nitrided material. That is, the present inventors found that the above-mentioned metallic element contained in the nitrided material reacts with the halogen gas and its plasma to accelerate a formation of a passive film on the surface of the nitrided material. The corrosion was inhibited from extending into the nitrided material by the passive film.

The passive film itself is physically etched in the plasma of the halogen-based corrosive gas by receiving a bombardment of the high-energy gas. However, at least one metallic element selected from Group 2A, Group 3A and Group 4A in Periodic Table existing in the nitrided material and the underlying substrate reproduce the passive film by diffusing toward the surface of the nitrided material. Therefore, the number of reproducing the passive film, or the resistivity was found to depend on the concentrate of the above-mentioned metallic element(s) in the film and the substrate.

Summarizing the findings in the above, the structural body of the present invention has two features:

(1) the nitrided material on the surface absorbs a difference between the substrate in the thermal expansions as the mixed film of the aluminum nitride phase and the metallic aluminum phase; and (2) by incorporating at least one metallic element selected from Group 2A, Group 3A and Group 4A into Periodic Table at least in the nitrided material, when the structural body is exposed to the halogen-based corrosive gas and its plasma, especially to the fluorine-based gas and its plasma, the chemical corrosion resistance against these gases and plasmas is improved by the passive film formed on the surface by halide, which is formed with the metallic element.

By combining these features, the structural body of the present invention is extremely stable even under such a circumstance that exposes the structural body to the halogen-based corrosive gas and its plasma, especially under a circumstance that causes such exposure of the structural body at a high temperature of not less than 200° C.

Among the metallic element selected from Group 2A, Group3A and Group 4A in Periodic Table, the nitrided material preferably contains magnesium, since magnesium acts effectively in the process of forming the nitride film as well as it is one of metal elements having an especially low vapor pressure of a fluoride formed upon exposing to the fluorine-based gas.

In a preferred embodiment, the nitrided material contains 1–10 atm % of at least one metallic element selected from Group 2A, Group 3A and Group 4A in Periodic Table. More preferably, the nitrided material contains not less than 3 atm % of the metallic element(s).

Moreover, in a preferred embodiment, the substrate contains 1–10 atm % of at least one metal selected from Group 2A, Group 3A and Group 4A in Periodic Table. When the passive film formed on the nitrided material is gradually derogated by a physical corrosion, the metallic element gradually moves from the substrate to the nitrided material, and further to the passive film to regenerate the passive film. From this viewpoint, the substrate containing not less than 3 atm % of the metallic element is more preferable.

The present inventors also found that if the nitrided material contained a metallic element selected from Group 4B in Periodic Table, the metallic element tended to evaporate upon being exposed to the halogen-based corrosive gas and its plasma to readily cause the chemical corrosion.

Accordingly, from this viewpoint, the amount of the metallic element selected from Group 4B in Periodic Table is preferably not more than 0.5 atm %, and the amount of silicon atoms is substantially not more than 0.5 atm % in the nitrided material. More preferably, substantially no silicon atoms is contained in the nitrided material.

The terms "nitrided material" of the present invention refers to a material obtained from a nitriding process of metallic aluminum, and more particularly, a material obtained by partially nitriding metallic aluminum. Therefore, a part of the metallic aluminum is not nitrided to remain in the nitrided material.

The proportion of the aluminum nitride phase in the nitrided material is preferably 10–90 mol %, when the sum of the aluminum nitride phase and the metallic aluminum phase is set to 100 mol %.

If the proportion of the aluminum nitride phase is not more than 10 mol %, the nitriding may be performed insufficiently to cause low hardness of the nitrided material and low resistivity against the physical corrosion. From this viewpoint, the proportion of the aluminum nitride phase is further preferably not less than 20 mol %.

If the proportion of the aluminum nitride phase excess 90 mol %, the durability of the structural body against heat cycling is degraded and the nitrided material tends to peel off. From this viewpoint, the proportion of the aluminum nitride phase is further preferably not more than 80 mol %.

In order to exert the physical and chemical resistivity of the nitrided material, the thickness of the nitrided material is preferably not less than 3 $\mu$m. The thickness is more preferably not less than 10 $\mu$m. The thickness of the nitrided material has no particular upper limit.

Other metallic element, for example, the above-mentioned metallic element(s) selected from Group 2A, Group 3A, Group 4A and Group 4B in Periodic Table may be contained in the nitrided material. Such metallic element (s) other than aluminum may be contained in the form of metal nitride(s), but it is particularly preferable that it is (they are) dissolved as an alloy in aluminum.

A type of substrate is not limited, but a metallic aluminum-containing metal is preferred. Pure metallic aluminum and an alloy of metallic aluminum and other metal(s) can be recited by way of example of such a metal. The other metal is not restricted, but includes the above-mentioned metallic element(s).

In order to achieve higher heat resistance, the substrate may also be an intermetallic compound containing aluminum atoms, and a composite material of a metallic aluminum-containing metal and a metallic aluminum-containing intermetallic compound. $Al_3Ni$, $Al_3Ni_2$, AlNi, $AlNi_3$, $AlTi_3$, AlTi, $Al_3Ti$ may be recited by way of example of the intermetallic compound containing aluminum atoms. Pure metallic aluminum and the alloy of metallic aluminum and other metal(s) may be recited by way of example of the metallic aluminum-containing metal.

Furthermore, the substrate is preferably a composite material of the metallic aluminum-containing metal and a low thermal expansion material, and is preferably a composite material of the above-mentioned intermetallic compound and the low thermal expansion material. In this case, the low thermal expansion material is preferably at least one low thermal expansion material selected from AlN, SiC, $Si_3N_4$, BeO, $Al_2O_3$, BN, Mo, W and carbon. The content of the low thermal expansion material is preferably 10–90 vol %.

A member comprising a metal, a ceramic material, an intermetallic compound, a composite material or the like having its surface coated with aluminum or an aluminum alloy may be used as a substrate.

The present invention relates to a halogen-based corrosive gas-resistant structural body comprising a substrate containing at least metallic aluminum and a nitrided material formed thereon, wherein the nitrided material is composed mainly of aluminum nitride phase and a metallic aluminum phase, and the nitrided material contains 1–10 atm % of at least one metallic element selected from Group 2A, Group3A and Group 4A in Periodic Table.

The present invention also relates to a halogen-based corrosive gas-resistant material, which is composed mainly of an aluminum nitride phase and a metallic aluminum phase and contains 1–10 atm % of at least one metallic element selected from Group 2A, Group 3A and Group 4A in Periodic Table. Unlike the above-mentioned structural body, this material may not necessarily be in a film form. It may take one of various kinds of forms such as a plate, a film or a sheet separated from the substrate.

The present invention further relates to a halogen-based corrosive gas-resistant structural body comprising a substrate containing at least metallic aluminum, a nitrided material formed on the substrate and a passive film formed thereon, wherein the nitrided material is composed mainly of an aluminum nitride phase and a metallic aluminum phase and contains 1–10 atm % of at least one metallic element selected from Group 2A, Group 3A and Group 4A in Periodic Table, and the passive film contains mainly an aluminum nitride phase, a metallic aluminum phase and a fluoride phase of the above-mentioned metallic element.

The present invention still further relates to a halogen-based corrosive gas-resistant structural body, which comprises a halogen-based corrosive gas-resistant material and a passive film formed thereon, the material being composed mainly of an aluminum nitride phase and a metallic aluminum phase and containing 1–10 atm % of at least one metallic element selected from Group 2A, Group 3A and Group 4A in Periodic Table, and the passive film containing mainly an aluminum nitride phase, a metallic aluminum phase and a fluoride phase of the above-mentioned metallic element.

Since the above-mentioned metallic element has a lower vapor pressure than that of metallic aluminum in a fluorinating process, a passive film of the obtained fluoride has high stability.

For the above-mentioned reason, the compositional proportion of the aluminum nitride phase is preferably 30–80 mol %, when the sum of the aluminum nitride phase and the metallic aluminum phase in the passive film is taken as 100 mol %.

The compositional proportion of the at least one metallic element selected from Group 2A, Group3A and Group 4A in Periodic Table is preferably 1–10 mol %.

Next, a method of producing the heat-resistant structural body and the halogen-based corrosive gas-resistant structural body according to the present invention will be described.

In order to produce these structural bodies, a substrate containing metallic aluminum is heated under high vacuum degree, more preferably under the presence of a material which contains at least one metal selected from Group 2A, Group 3A and Group 4A in Periodic Table or a vapor thereof, followed by heating in nitrogen atmosphere without any other treatment. It is considered that an alumina passive film on the surface of the aluminum substrate is removed by the heat treatment under high vacuum degree, and thus the surface is readily nitrided. Such a process itself is also described in Japanese Patent Application No. 11-059011 (Priority Date Feb. 4, 1999: JP-A-2000-290767).

In order to produce the heat-resistant structural body and the halogen-based corrosive gas-resistant structural body of the present invention, the substrate is necessary to have the heat treatment under vacuum of not more than $10^{-3}$ torrs, and preferably not more than $5\times10^{-4}$ torrs.

The lower limit of the pressure in vacuum is not particularly limited, but it is preferably $10^{-6}$ torrs, and more preferably $10^{-5}$ torrs. A larger pump and a higher-vacuum tolerant chamber are necessary to achieve a higher vacuum degree, thereby raising the cost. However, even when the vacuum degree is less than $10^{-6}$ torrs, the nitride-forming rate is not particularly enhanced as compared to that of $10^{-5}$ or $10^{-6}$ torrs and so it is not practically useful to reduce the vacuum degree below $10^{-6}$ torrs.

The lower limit of the temperature of the heat treatment is not particularly limited as far as the nitrided material can be formed on the surface of the substrate. However, to form the nitrided material easily and shortly, the lower temperature limit is preferably 450° C., and more preferably 500° C.

The upper limit of the temperature of the heat treatment is not also particularly limited, either, but it is preferably 650° C., and more preferably 600° C. By so setting, a thermal deformation of the substrate containing aluminum can be prevented.

A nitrogen-containing gas, such as $N_2$ gas, $NH_3$ gas and mixed gas such as $N_2/NH_3$ gas may be used as the nitrogen atmosphere in the heating/nitriding treatment. In order to form a thick nitrided material on the heat-treated substrate in a relatively short time, the gas pressure of the nitrogen atmosphere is preferably set at not less than 1 kg/cm$^2$, more preferably in a range from 1 to 2000 kg/cm$^2$, and particularly preferably in a range from 1.5 to 9.5 kg/cm$^2$.

The heating temperature in the heating/nitriding treatment is not particularly limited as far as the nitrided material can be formed on the surface of the substrate. However, to form a relatively thick nitrided material in a relatively short time, the lower limit of the heating temperature is preferably 450° C. as mentioned above, and more preferably 500° C.

Further, the upper limit of the heating temperature in the heating/nitriding treatment is preferably 650° C., and more preferably 600° C. By so setting, a thermal deformation of the substrate can be effectively prevented.

The nitrided material thus formed on the surface of the substrate is not necessarily in the form of a layer or a film. That is, the form of the nitrided material is not limited as far as it is formed in such a state that it can afford corrosion resistance on the substrate itself. Therefore, the form includes such a state that fine particles of the nitrided material are densely dispersed or the composition of the nitrided material inclines toward the substrate with an interface between the nitrided material and the substrate being unclear. In fact, it is most preferable that the nitrided material is continued in the form of a layer or a film.

The concentration of oxygen in the nitrided material is preferably not more than two third of that in the substrate.

When the structural body of the present invention is to be manufactured, a substrate is placed on a sample table inside a chamber equipped with a vacuum device. Next, this chamber is evacuated with the vacuum pump until a given vacuum degree is achieved. Then, the substrate is heated with a heater, such as a resistant heating element placed in the chamber, until a given temperature is achieved. The substrate is held at this temperature for 1 to 10 hours.

After the heating treatment, the interior atmosphere of the chamber is replaced with a nitrogen gas by introducing the nitrogen gas or the like into the chamber. By adjusting the input power of the heater, the substrate is heated to a given temperature. Then, the substrate is held at this temperature for 1 to 30 hours.

After the given time has passed, the heating/nitriding treatment is terminated by stop heating and introducing the nitrogen gas. Then, the interior atmosphere of the chamber is cooled down, and the substrate is taken out from the chamber.

The structural body and the halogen-based corrosive gas-resistant material of the present invention can be used as a component in the semiconductor-producing apparatuses, the liquid crystal-producing apparatuses, the automobiles, etc. Further, the structural body of the present invention has excellent heat emission property. Therefore, the structural body can be favorably used in a heat emission component requiring the heat emitting property.

The halogen-based corrosive gas-resistant material and the halogen-based corrosive gas-resistant structural body according to the present invention have superior corrosion resistance against chlorine-based corrosive gases such as $Cl_2$, $BCl_3$, $ClF_3$ and HCl, fluorine-based corrosive gases such as a $ClF_3$ gas, a $NF_3$ gas, a $CF_4$ gas, $WF_6$ and $SF_6$, and plasmas thereof. In addition, the ambient temperature during the exposure to such a gas or plasma may be in a wide range from room temperature to 800° C. Particularly, the structural body and the material of the present invention have superior corrosion resistance even in a high temperature region of 200–800° C.

EXAMPLES 1–6

Each of the structural bodies of Example 1 to 6 was produced according to the above-mentioned method under conditions of heat treatment and heating/nitriding treatment as shown in Table 1.

More specifically, substrates having dimensions of 20×20×2 mm were prepared. In Examples 1 and 4, pure aluminum (A1050: Al content>99.5%), an Mg—Si based Al alloy (A6061: 1Mg—0.6Si—0.2Cr—0.3Cu) and an Al—Mg alloy (A5083: 4.1Mg—0.25Cr) were used as the substrates. A combination of a cup-shaped vessel body made of graphite (porosity 10%) and a lid made of graphite (screw type) was used as a reaction vessel. All of the vessels had dimensions of 90 mm in inner diameter and 7 mm in height, and were formed in cup-shape.

As a pre-treatment, the substrates were vacuum-baked at 2000° C. in not more than $1\times10^{-3}$ Torrs for 2 hours. Three substrates were placed in each of the reaction vessels. Each of the reaction vessels was placed in an electric furnace equipped with a graphite heater, and the furnace was evacuated to a vacuum degree given in Table 1 with a vacuum pump and a diffusion pump. Then, the substrate was heated to a temperature given in Table 1 by passing current through the graphite heater, and the substrate was held under vacuum at this temperature for a period of time given in Table 1. In the case of forming a nitride film of pure aluminum, three of the A6061 plates as well as three of the A1050 plates were also placed in the vessel.

Thereafter, nitrogen gas was introduced into the electric furnace to reach a set pressure given in Table 1. After the set pressure was achieved, the nitrogen gas was introduced at a rate of 2 liter/min., and an inside pressure of the furnace was controlled within ±0.05 kg/cm$^2$ of the set pressure. Then, the temperature and the holding time of the substrate were set as shown in Table 1, and a nitride film was formed on the surface of the substrate. When the nitride film-formed substrate was cooled to 50° C. or less, the substrate was taken out from the chamber.

The surfaces of the nitrided members were subjected to the X-ray diffraction examination so that peaks of aluminum nitride and metallic aluminum were observed in each of the members.

The surface of the nitrided film was also subjected to an EDS analysis, which also detected N, Mg and Si as well as Al. The measured quantities of the EDS analysis are shown in Table 2. As an EDS analysis equipment, a combination of an SEM (Model XL-30) manufactured by Philips Co., Ltd. and an EDS detector (Model CDU-SUTW) manufactured by EDAX Co., Ltd was used. The plane analysis was conducted under conditions of an acceleration voltage of 20 kV and a magnification of ×1000.

TABLE 1

| | Heating condition | | | Heating/nitriding condition | | | | |
|---|---|---|---|---|---|---|---|---|
| | Vacuum | | | $N_2$ Gas | | | Substrate | |
| Example | degree (torr) | Temp. (° C.) | Time (hr) | pressure (kgf/cm$^2$) | Temp. (° C.) | Time (hr) | Number of pieces | Material |
| 1 | $1.2\times10^{-4}$ | 540 | 2 | 1 | 540 | 8 | A6061 × 3<br>A1050 × 3 | A1050 |
| 2 | $1.2\times10^{-4}$ | 540 | 2 | 9.5 | 540 | 2 | 3 | A6061 |
| 3 | $1.3\times10^{-4}$ | 540 | 2 | 2 | 540 | 0.5 | 3 | A5083 |
| 4 | $1.2\times10^{-4}$ | 540 | 2 | 5 | 540 | 2 | A6061 × 3<br>A1050 × 3 | A1050 |
| 5 | $1.2\times10^{-4}$ | 540 | 2 | 5 | 540 | 2 | 3 | A6061 |
| 6 | $1.3\times10^{-4}$ | 540 | 2 | 1 | 540 | 2 | 3 | A5083 |

TABLE 2

| | | | SEM | Result of EDS analysis | | | | | | | | | | | | | |
|---|---|---|---|---|---|---|---|---|---|---|---|---|---|---|---|---|---|
| | | XRD Crystal | Film Thickness | Surface (atm %) | | | | Cross-section (atm %) | | | | Surface after the corrosion test (atm %) | | | | |
| Example | Substrate | phase | (μm) | N | Mg | Al | Si | N | Mg | Al | Si | N | Mg | Al | Si | F |
| 1 | A1050 | AlN,Al | 20 | 25 | 1 | 73 | 1 | 19 | 1 | 79 | 1 | 19 | 5 | 63 | 0 | 13 |
| 2 | A6061 | AlN,Al | 9 | 21 | 4 | 68 | 7 | 26 | 3 | 68 | 3 | 13 | 12 | 43 | 2 | 30 |
| 3 | A5083 | AlN,Al | 17 | 29 | 5 | 76 | 0 | 20 | 4 | 76 | 0 | 16 | 14 | 50 | 0 | 20 |
| 4 | A1050 | AlN,Al | 19 | 27 | 1 | 72 | 0 | — | — | — | — | 21 | 4 | 58 | 0 | 17 |
| 5 | A6061 | AlN,Al | 11 | 27 | 3 | 67 | 3 | — | — | — | — | — | — | — | — | — |
| 6 | A5083 | AlN,Al | 14 | 35 | 5 | 60 | 0 | 21 | 4 | 75 | 0 | 17 | 20 | 38 | 0 | 25 |

As clearly shown in Table 2, the measured quantities of Al and N were all rich in aluminum contents, which varied depending on the type of the substrate and the nitriding condition. The sensitivity of EDS in the thickness direction is said to be a few micrometers. As a film thickness of the nitride film (describes later) is not less than 10 μm, it is recognized that the results of the surface EDS analysis give information inside the nitride film. Therefore, the nitride film was confirmed to have much aluminum as its component.

Further, an SEM/EDS observation was performed on a cross section face of the nitride film to investigate a film thickness and a compositional distribution. The results are shown in Table 2. As clearly shown in Table 2, the film thickness depended on the type of the substrate and the nitriding condition. The results of an EDS analysis on the cross section face revealed that N/Al ratio was less than 1, which supported the results obtained by the EDS analysis on surface.

The results of the X-ray diffraction revealed that crystals of AlN were formed in the nitride film. The results of the EDS analysis showed that the nitride film contained much aluminum as its component. These results revealed that the nitride film was not a film which was formed only by an aluminum nitride phase, but a film in which considerable metallic aluminum mixed. By the EDS analysis, Mg and Si were detected in the nitride film of some kinds of substrates, which showed that the film consisted of at least three phases such as AlN/Al/Mg.

Then, each of obtained specimens was subjected to a heat-cycling test and a heat impact test as well as a peeling test. A test condition is shown below. Results are shown in Table 3.

(Heat-Cycling Test)

The specimen was heated from room temperature to 200° C. at a heating rate of 10° C./min, held at 200° C. for 1 hour, and then cool down to room temperature in 4 hours. This cycle was repeated ten times.

(Heat Impact Test)

The specimen was heated to 450° C., and then dropped into water of room temperature.

(Peeling Test)

A commercial gum tape was cut into a 10 mm-width piece, and the cut piece was attached on the surface of the nitride film, and then peeled off.

TABLE 3

| | | | SEM | | | | Corrosion resistant test | |
|---|---|---|---|---|---|---|---|---|
| Example | Substrate | XRD Crystal phase | Film thickness (μm) | Heat cycling test | Heat impact test | Peeling test | $NF_3$ gas Weight loss ($mg/cm^2$) | HF solution Weight loss ($mg/cm^2$) |
| 1 | A1050 | AlN, Al | 20 | Good | Good | No peeling | 0.55 | −0.01 |
| 2 | A6061 | AlN, Al | 9 | Good | Good | No peeling | 0.56 | 0.00 |
| 3 | A5083 | AlN, Al | 17 | Good | Good | No peeling | 0.11 | 0.00 |
| 4 | A1050 | AlN, Al | 19 | Good | Good | No peeling | 0.52 | −0.01 |
| 5 | A6061 | AlN, Al | 11 | Good | Good | No peeling | — | 0.00 |
| 6 | A5083 | AlN, Al | 14 | Good | Good | No peeling | 0.13 | 0.00 |

Defect, such as peeling or crack of the film, was not formed in nitride films of the any substrates after the heat-cycling test and the heat impact test. No peeling of the film was observed in the peeling test as well.

A corrosion resistant test against a fluorine-based corrosive gas was also conducted on each of the obtained specimen members. Each of the specimens was exposed to the plasma of $NF_3$ gas. Specifically, $NF_3$ gas was changed into plasma at 550° C. by inductively coupled plasma. A flow rate of the mixed gas was 75 SCCM, a flow rate of $N_2$ gas was 100 SCCM, pressure was 0.1 torrs, alternating electric power was 800 watts, its frequency was 13.56 MHz, and exposure time was 2 hours. A weight loss after the test was calculated by the following equation:

(weight of the specimen before the exposure−weight of the specimen after the exposure)/exposed area.

The results of the EDS analysis and the weight losses after the corrosion resistant tests are shown in Table 2, and Table 3, respectively.

In each of Examples 1 to 6, the weight gained about 0.1–0.6 $g/cm^2$ between before and after the test, and Mg and F were concentrated at the surface. From these results, it was revealed that the weight of the specimen gained, and an etching effect was not caused when the specimen was exposed to the fluorine-based corrosive gas. The reason for this is inferred that magnesium diffuses from the nitride film and an inside of the substrate to the surface, deposits on the surface, and forms a compound with fluorine (probably $MgF_2$), thereby passivating the film. Especially, the specimen of Examples 3 and 6 exhibited high corrosion resistance.

Then, the surfaces of the specimens of Examples 3 and 6 after the corrosion resistant test were grinded with emery paper to remove MgF-based compounds. Subsequently, the above-mentioned corrosion resistant test was performed again. The results were similar to the first ones, and a compound of Mg and F was formed on the surface to passivating the film. Under a low temperature plasma environment such as in a semiconductor-producing device, not only chemical reactions, but also sputtering were considered to be caused. The passive film may possibly be removed physically depending on a corrosion environment. However, by the above-mentioned tests, it was revealed that the passive film was formed again after removing it. That is, the member was proved to be able to form the passive film against the corrosive gas by itself.

Next, corrosion resistant tests against HF solution were performed on each of the specimens.

In semiconductor producing devices, a corrosion of specimen after an air purging often becomes a problem. It is considered that a halogen gas bonding on the surface of the specimen reacts with $H_2O$ in the air after being exposed to the air to form HF, HCl and the like, thereby causing this phenomenon of corroding the specimen. In this embodiment, each of the specimens was immersed in 5% HF solution for 5 minutes, and the corrosion resistance against HF solution was examined by a weight change between before and after the immersion and an observation of the surface of the specimen with a scanning electron microscope after the immersion test. The results are shown in Table 3.

No weight change was detected in each of the specimens, and no difference was observed in the surface state. From these results, it is considered that the nitrided material of the present invention is stable against the HF solution and is less affected by the corrosion in the air when it is used for semiconductor processes.

COMPARATIVE EXAMPLES 1–7

As comparative examples, tests were performed on various aluminum specimens (not particularly surface-treated) or specimens of various alumite-treated (anodized film of an aluminum member) aluminum alloys, which were known as members for semiconductor producing devices (fluorine-based plasma devices).

Particularly, substrates of alumite-treated aluminum alloys were used for Comparative Examples 1–3. The dimensions of each of the specimen were 20×20×2 mm. Pure aluminum (A150: Al content>99.5%), Mg—Si based Al alloy (A6061: 1Mg—0.6Si—0.2Cr—0.3Cu) and Al—Mg alloy (A5083: 4.1Mg—0.25Cr) were used. Each of the anodized films had a thickness of 50 μm.

In addition, each of the specimens for Comparative Examples 4, 5, 6 and 7 made of an aluminum alloy with no particular surface-treatment was prepared. Al—Si-based alloy (A4047: Al—12Si), which was widely used as a member for semiconductor producing devices, was also evaluated as Comparative Example 7.

Results of EDS analysis on the surface of each of the specimens are shown in Table 4. A heat-cycling test, a heat impact test, a peeling test, a corrosion resistant test against the $NF_3$ gas and a corrosion resistant test against immersion of the HF solution were performed on each of the specimens in the same manner of Example 1–6. Results of the tests on each of the specimens are shown in Table 5. Results of EDS analysis on each surface the specimens after the corrosive resistant test against the $NF_3$ gas are shown in Table 4.

TABLE 4

| Comparative Example | | Substrate | Film thickness (μm) | Result of EDS analysis: Before the corrosion resistant test (atm %) O | Mg | Al | S | Si | F | After the corrosion resistant test (atm %) O | Mg | Al | S | Si | F |
|---|---|---|---|---|---|---|---|---|---|---|---|---|---|---|---|
| 1 | Anodized film Alumite | A1050 | 50 | 58 | 0 | 37 | 5 | 0 | 0 | 50 | 0 | 44 | 6 | 0 | 0 |
| 2 | Anodized film Alumite | A6061 | 50 | — | — | — | — | — | — | 49 | 2 | 43 | 5 | 1 | 0 |
| 3 | Anodized film Alumite | A5083 | 50 | — | — | — | — | — | — | 50 | 4 | 41 | 5 | 0 | 0 |
| 4 | Pure Al alloy (Al 99.5%) | A1050 | — | 0 | 0 | 100 | 0 | 0 | 0 | 0 | 0 | 42 | 0 | 0 | 58 |
| 5 | Al alloy (Al—Mg—Si) | A6061 | — | 0 | 2 | 97 | 0 | 1 | 0 | 0 | 16 | 60 | 0 | 4 | 17 |
| 6 | Al alloy (Al—Mg) | A5083 | — | 1 | 4 | 95 | 0 | 0 | 0 | 0 | 21 | 59 | 0 | 0 | 20 |
| 7 | Al alloy (Al—Si) | A4047 | — | 3 | 0 | 77 | 0 | 20 | 0 | 0 | 0 | 42 | 0 | 0 | 58 |

TABLE 5

| Comparative Example | | Substrate | Film thickness (μm) | Heat cycling test | Heat impact test | Corrosion resistant test: $NF_3$ gas Weight loss ($mg/cm^2$) | HF solution Weight loss ($mg/cm^2$) |
|---|---|---|---|---|---|---|---|
| 1 | Anodized film Alumite | A1050 | 50 | NG | NG | 0 | 2.20 |
| 2 | Anodized film Alumite | A6061 | 50 | NG | NG | 0.01 | 2.60 |
| 3 | Anodized film Alumite | A5083 | 50 | NG | NG | −0.01 | 2.34 |
| 4 | Pure Al alloy (Al 99.5%) | A1050 | — | — | — | 605 | 3.10 |
| 5 | Al alloy (Al—Mg—Si) | A6061 | — | — | — | 0.7 | 3.54 |
| 6 | Al alloy (Al—Mg) | A5083 | — | — | — | −0.1 | 3.12 |
| 7 | Al alloy (Al—Si) | A4047 | — | — | — | −2.1 | 4.49 |

The specimens of Comparative Examples 1–3 using the anodized film exhibited good results in the corrosive gas resistant test, but caused peeling of the film after the test in both of the heat-cycling test and the heat impact test. The large weight reduction was observed in the HF immersion test, thereby proving the film being porous.

The specimens of Comparative Examples 4–7 except Al—Si-based alloy had nearly same amount of weight gain, but exhibited a dependency of the corroded state on the kind of the substrate. In case of pure aluminum (A1050) (Comparative Example 4), peeing and crack of the film were caused on the surface after the corrosive gas resistant test. It is considered from the EDS analysis that an $AlF_3$ film was formed on the surface of pure aluminum, but that the difference in thermal expansion coefficient between the $AlF_3$ film and the substrate was large, so that the film was broken during the temperature reduction.

In case of an Al—Mg-based alloy (Comparative Example 6) and an Al—Mg—Si-based alloy (Comparative Example 5), Mg and F based compounds as well as the nitride film were formed to passivate the surface, and the surface state did not change from that before the test.

Al—Si-based alloy (Comparative Example 7) was selectively etched at a segregated part of Si, and the surface of the substrate became a porous state. This is surmised to be because a vapor pressure of the Si—F-based compound was high. Thus, the corrosion resistance was extremely low. From the above results, the Mg-containing alloy is good for the corrosive gas resistance among the Al alloys.

In the HF solution immersing test, all of the substrates including Mg-containing alloy exhibited extremely high corrosion rates, and the corrosion resistances against the HF solution were low.

As having been described in the above, according to the present invention, the heat-cycling durability of the structural body in which the nitrided material is provided on the substrate containing at least metallic aluminum can be improved. The halogen-based corrosive gas-resistance of the structural body in which the nitrided material is provided on the substrate containing at least metallic aluminum can be further improved. Further, the nitrided material having high resistance against hydrofluoric acid and halogen-based corrosive gas and high heat-resistance can be provided.

What is claimed is:

1. A halogen-based corrosive gas-resistant structural body comprising a substrate containing at least metallic aluminum, a nitrided material formed on the substrate and a passive film formed on the nitrided material, wherein said nitrided material is composed mainly of an aluminum nitride phase and a metallic aluminum phase, and contains 1–10 atm % oft least one metallic element selected from Group 2A, Group 3A and Group 4A in the Periodic Table, and said passive film mainly contains an aluminum nitride phase, a metallic aluminum phase and a fluoride phase of said metallic element.

2. A halogen-based corrosive gas-resistant structural body as defined in claim 1, wherein said fluoride phase comprises a magnesium fluoride phase.

3. A halogen-based corrosive gas-resistant structural body as defined in claim 1, said nitrided material contains 1–10 atm % of magnesium.

4. A halogen-based corrosive gas-resistant structural body as defined in claim 1, said nitrided material further comprises a metallic element selected from Group 4B in the Periodic Table in an amount of 0.5 atm % or less.

5. A halogen-based corrosive gas-resistant structural body as defined in claim 4, which contains substantially no silicon atoms.

6. A halogen-based corrosive gas-resistant structural body as defined in claim 5, which contains substantially no metallic element selected from Group 4B.

7. A halogen-based corrosive gas-resistant structural body, comprising a halogen-based corrosive gas-resistant material and a passive fun formed on the halogen-based corrosive gas-resistant structural body, said halogen-based corrosive gas-resistant material being composed mainly of an aluminum nitride phase and a metallic aluminum phase, and containing 1–10 atm % of at least one metallic element selected from Group 2A, Group 3A and Group 4A in the Periodic Table, and said passive film mainly containing an aluminum nitride phase, a metallic aluminum phase and a fluoride phase of said metallic element.

8. A halogen-based corrosive gas-resistant structural body as defined in claim 7, wherein said fluoride phase comprises a magnesium fluoride phase.

9. A halogen-based corrosive gas-resistant structural body as defined in claim 7, wherein said halogen-based corrosive gas material contains 1–10 atm % of magnesium.

10. A halogen-based corrosive gas-resistant structural body as defined in claim 7, said halogen-based corrosive gas-resistant structural body further comprising a metallic element selected from Group 4B in the Periodic Table in an amount of 0.5 atm % or less.

11. A halogen-based corrosive gas-resistant structural body as defined in claim 10, which contains substantially no silicon atoms.

12. A halogen-based corrosive gas-resistant structural body as defined in claim 11, which contains substantially no metallic element selected from Group 4B in the Periodic Table.

* * * * *